United States Patent [19]

Miyagawa

[11] 4,227,073

[45] Oct. 7, 1980

[54] CHECK NUMBER COUNTER DEVICE FOR PAPER COUNTING MACHINE

[75] Inventor: Tuyoshi Miyagawa, Tokyo, Japan

[73] Assignee: Laurel Bank Machine Co., Ltd., Tokyo, Japan

[21] Appl. No.: 953,747

[22] Filed: Oct. 23, 1978

[30] Foreign Application Priority Data

Oct. 25, 1977 [JP] Japan ..... 52-143238[U]

[51] Int. Cl.[2] ..... G06M 7/06

[52] U.S. Cl. ..... 235/92 SB

[58] Field of Search ..... 235/92 SB, 92 SA, 89 R, 235/89 A; 271/90, 262, 258

[56] References Cited

FOREIGN PATENT DOCUMENTS 1371100 10/1974 United Kingdom ..... 235/92 SB

*Primary Examiner*—Leo H. Boudreau

*Attorney, Agent, or Firm*—Fleit & Jacobson

[57] ABSTRACT

Herein disclosed is a check number counter device for use with a paper counting machine, by which sheets of paper are counted while being sucked and taken off (or deflected) one by one with the use of rotatable suction cylinder. The check number counter device includes an AND gate which is made responsive to both a coincidence signal indicating that the number checking operation is terminated and the operation terminating signal indicating that the operations of the suction cylinders are terminated so that it may generate a gate output, when it receives both the coincidence signal and the operation terminating signal, but may not generate the gate signal when it receives the latter signal but not the former signal. Further inclusive is a check number counter which is made responsive to the gate signal of the AND gate so that it may count the checked number.

1 Claim, 4 Drawing Figures

CHECK NUMBER COUNTER DEVICE FOR PAPER COUNTING MACHINE

BACKGROUND OF THE INVENTION

1. Field of the Invention

The present invention relates to a paper counting machine, and more particularly to a check number counter device for use with the paper counting machine.

2. Description of the Prior Art

In a conventional paper counting machine, sheets of paper are sucked and taken off (or deflected) one by one by means of a plurality of rotatable sucking cylinders so that they may be counted. If a number of bundles of election paper are to be checked with the use of the paper counting machine, its operator is required to write and record his checked number and to count the number of the bundles handled by himself after his work. This manual check cannot be free from inefficiency.

SUMMARY OF THE INVENTION

It is therefore an object of the present invention to provide a check number counter device for use with a paper counting machine, which is free from the drawback concomitant with the prior art.

Another but major object of the present invention is to provide a check number counter device of the above type, which can be set in the paper counting machine without any difficulty so as to automatically indicate the checked number.

According to a major aspect of the present invention, there is provided a check number counter device for use with a paper counting machine including a suction cylinder for sucking to take off sheets of paper one by one so that the latter may be counted, and a vacuum switch for controlling the operations of said suction cylinder and for generating an operation terminating signal indicating that the operations of said suction cylinder are terminated, said check number counter device comprising: an AND gate made responsive to both a coincidence signal indicating that the number checking operation is terminated and the operation terminating signal of said vacuum switch so that it may generate a gate output, when it receives both the coincidence signal and the operation terminating signal, but may not generate the gate signal when it receives the latter signal but not the former signal; and a counter made responsive to the gate signal of said AND gate so that it may count the checked number.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENT

The present invention will now be described in connection with the preferred embodiment thereof with reference to the accompanying drawings.

Figure 3:
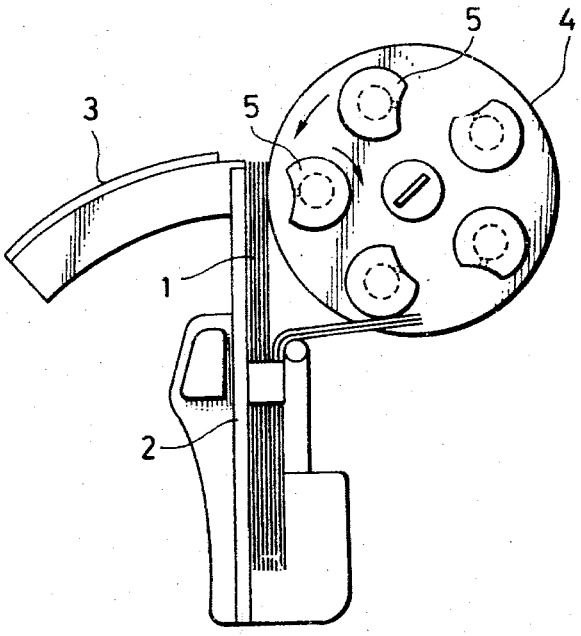
FIG. 3 is a top plan view showing in detail the counting portion of the paper counting machine.

Reference is made first to FIG. 3 showing a top plan view of a portion of a paper counting machine of the prior art. As shown, a bundle of sheets of paper 1 is so held on a holder 2 that it may be moved along a paper arranger 3. The sheets of paper 1 thus held are sucked and taken off (or deflected) one by one for their counting purpose by means of a plurality of suction cylinders 5 which are mounted rotatably on the upper surface of a rotating suction drum 4.

Figure 1:
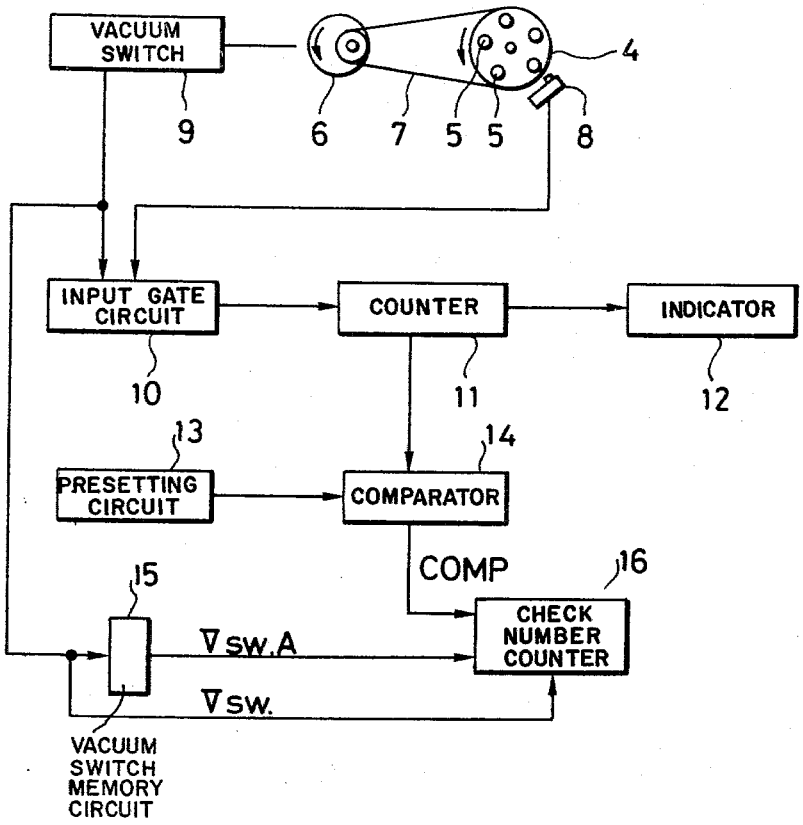
FIG. 1 is a block diagram showing a circuit of a paper counting machine of the prior art in combination with a check number counter device to be used with the paper counting machine, in accordance with the present invention.

Turning to FIG. 1, this figure shows in part a circuit of the prior art, an electric motor 6, an endless belt 7, an approach switch 8, a vacuum switch 9, an input gate circuit 10, a counter circuit 11, an indicator 12, a presetting circuit 13 and a comparator circuit 14, all of which are made coactive with each other in the manner shown in arrows. The operations of the circuit are quite well known to those skilled in the art, and as such their descriptions are omitted here. See, for example, Japanese Utility Model Publication No. 35741/1979 (Laid Open Publication No. 85280/1975). In FIG. 1, moreover, reference numerals 15 and 16 indicate a vacuum switch memory circuit 15 and a check number counter device 16, both of which are made coactive with the vacuum switch 9 and the comparator circuit 14, as seen from arrows. Reference letters VSW and VSWA indicate the output signals of the vacuum switch 9 and the memory circuit 15, respectively.

Figure 2:
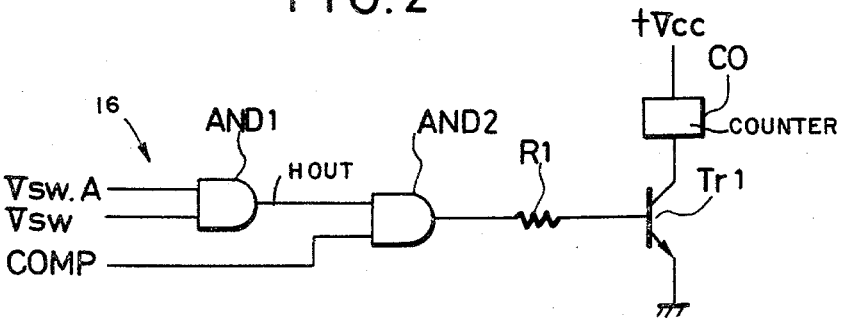
FIG. 2 is a detailed block diagram of a portion of the circuit of the check number counter device 16 of FIG. 1, according to the present invention.

Turning further to FIG. 2, there is presented a circuit which is made operative in response to the operation terminating signals VSW of the vacuum switch 9. In this circuit, reference characters COMP indicate coincidence signals, AND 1 and AND 2 AND gates, R 1 a resistor, Tr 1 a transistor, and CO a counter. Reference characters +Vcc indicate a voltage which is applied to the counter CO. Thus, with the use of the circuit thus constructed, the sheets of paper 1 can be counted and checked for each bundle such that they are sucked and taken off one by one by the action of the rotatable suction cylinders 5, as seen from FIG. 3.

In this instance, when the output signal VSWA, indicating that the vacuum switch 9 is in operation is at a high level H and when the output signal VSW indicating that the suction cylinders 5 have not sucked the papers, is also at the high level H, the AND gate AND 1 becomes conductive to feed its output signal HOUT to the other AND gate AND 2. If, at this time, the coincidence signal COMP, indicating that the output from counter circuit 11 is coincident with or identical to the preset value from presetting circuit 13, is also at the high level H, the second AND gate AND 2 is rendered conductive so as to feed its current to the base of the transistor Tr 1 so that this transistor Tr 1 is rendered conductive to operate the counter CO.

In the above instance, however, if the coincidence signals COMP fail to reach the high level H, the AND gate AND 2 is kept nonconductive to leave the transistor Tr 1 nonconductive so that the counter CO does not start its operations.

In other words, if the AND gates are rendered conductive in response to the coincidence signals indicating the termination of the preset checking operations and to the operation terminating signals of the vacuum switch 9, the counting operations are carried out by the actions of the check number counter device 16. With the operation terminating signals but without the coincidence signals, no gate output is generated from the AND gates so that the counter is left inoperative.

Figure 4:
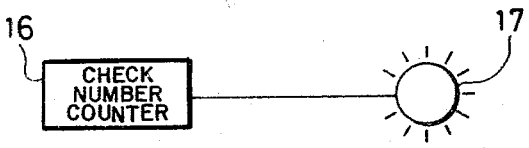
FIG. 4 is a block diagram showing an indicator of lamp type.

As shown in FIG. 4, moreover, in case the bundle of paper sheets is composed of bank notes, it may be so checked that a lamp 17 is turned on, when the indication of the check number counter device 16 reaches 10, so as to indicate that the number of the bundles handled reaches 10.

As has been described hereinbefore, a check number counter device to be used according to the present invention with the paper counting machine for counting sheets of paper while sucking and taking them off one by one with the use of rotatable suction cylinders is constructed such that, when an AND gate receives both the coincidence signals indicating that the checking operations of the sheet of paper by the actions of the suction cylinders are terminated and the operation terminating signals of the vacuum switch for controlling the operations of the suction cylinders, then the gate output is generated to count the number of the bundles of the paper sheets but such that, when the AND gate receives the operation terminating signals only but not the coincidence signals, then no gate output is generated to leave the check number counter inoperative. Thus, the check number counter device of the present invention accomplishes its counting operation, only when the checking operation for checking a preset number check is terminated and the coincidence signals are generated, but it does not perform its counting operation when no coincidence signal is generated even if the checking operation is terminated. Therefore, it is possible to automatically inform the operator of the correct number of the bundles of paper sheets handled and to accomplish the checking operations correctly and efficiently. Thus, the check number counter device of the present invention can be set in the conventional paper counting machine without any difficulty for proper practice.

What is claimed is:

1. In a paper counting machine, including:

a suction cylinder for sucking to deflect sheets of paper one by one so that the latter may be counted, a vacuum switch for controlling the operations of said suction cylinder for generating an operation terminating signal indicating when the operations of said suction cylinder are terminated, counter means for counting the number of said deflected sheets until generation of said operation terminating signal, and generating a counter output, and comparator means for comparing said counter output with a predetermined number, and issuing a coincidence signal when said counter output and said predetermined number coincide;

a check number counter device comprising:

AND gate means responsive to both said coincidence signal and the operation terminating signal of said vacuum switch for generating a gate output when both the coincidence signal and the operation terminating signal are received, and for not generating said gate output when both the coincidence signal and the operation terminating signal are not received; and counter means responsive to the gate signal of said AND gate means for counting occurences thereof, whereby to count the number of coincidence signals.

* * * * *